US009066574B2

(12) United States Patent
Cox

(10) Patent No.: US 9,066,574 B2
(45) Date of Patent: Jun. 30, 2015

(54) SUPPORT FOR AN ELECTRONIC DEVICE

(71) Applicant: Gary L. Cox, Spanish Fork, UT (US)

(72) Inventor: Gary L. Cox, Spanish Fork, UT (US)

( * ) Notice: Subject to any disclaimer, the term of this patent is extended or adjusted under 35 U.S.C. 154(b) by 99 days.

(21) Appl. No.: 14/034,017

(22) Filed: Sep. 23, 2013

(65) Prior Publication Data

US 2015/0083765 A1 Mar. 26, 2015

(51) Int. Cl.
*A45F 5/00* (2006.01)
*A45F 3/14* (2006.01)

(52) U.S. Cl.
CPC ..... *A45F 5/00* (2013.01); *Y10S 224/93* (2013.01); *A45F 2003/142* (2013.01); *A45F 2200/0525* (2013.01); *A45F 2005/006* (2013.01)

(58) Field of Classification Search
CPC ..... A45F 2200/0525; A45F 2005/006; A45F 2003/142
USPC ..... 224/259, 260, 261, 929
See application file for complete search history.

(56) References Cited

U.S. PATENT DOCUMENTS

| | | | | | |
|---|---|---|---|---|---|
| 4,272,852 | A * | 6/1981 | Bell | 2/94 |
| 4,764,962 | A * | 8/1988 | Ekman et al. | 381/301 |
| 5,440,761 | A * | 8/1995 | Abrams et al. | 2/102 |
| 5,465,888 | A * | 11/1995 | Owens | 224/680 |
| D394,338 | S * | 5/1998 | Lacey | D2/841 |
| 5,915,606 | A * | 6/1999 | Jensen | 224/148.6 |
| 5,961,014 | A * | 10/1999 | Knerr | 224/259 |
| 6,006,970 | A * | 12/1999 | Piatt | 224/257 |
| 6,199,731 | B1 * | 3/2001 | Lehoux | 224/260 |
| 6,224,450 | B1 * | 5/2001 | Norton | 446/28 |
| 6,648,191 | B2 * | 11/2003 | Giggleman | 224/260 |
| 6,655,564 | B1 * | 12/2003 | Zupan | 224/628 |
| 6,976,614 | B1 * | 12/2005 | Caramanis | 224/255 |
| 7,066,361 | B1 * | 6/2006 | Williams | 224/194 |
| 7,353,779 | B2 * | 4/2008 | Altieri | 119/770 |
| 7,387,225 | B2 * | 6/2008 | Fox | 224/257 |
| 7,665,641 | B2 * | 2/2010 | Kaufman | 224/261 |
| 7,780,049 | B1 * | 8/2010 | Baranoski | 224/250 |
| 8,657,166 | B1 * | 2/2014 | Harness | 224/259 |
| 8,708,284 | B2 * | 4/2014 | Gummeson | 244/151 A |
| 8,789,731 | B2 * | 7/2014 | Hart | 224/257 |
| 2003/0106916 | A1 * | 6/2003 | Boone | 224/161 |
| 2004/0200870 | A1 * | 10/2004 | Haber | 224/259 |
| 2005/0011920 | A1 * | 1/2005 | Feng | 224/275 |
| 2010/0237114 | A1 * | 9/2010 | Kaufman | 224/261 |
| 2013/0104297 | A1 * | 5/2013 | Silva et al. | 2/422 |

* cited by examiner

*Primary Examiner* — Justin Larson
(74) *Attorney, Agent, or Firm* — M. Reid Russell

(57) ABSTRACT

A support and arrangement for its connection to a harness or shoulder straps fitted to a motorcycle driver where the support is used to mount a electronic device, such as a tablet onto the drivers back for use by a motorcycle passenger during travel. The support includes support straps that each include a buckle for travel therealong that mounts a male connector where the buckles are capable of being adjusted along the supports straps by the passenger during travel, where the male connectors fit into female couplings secured to ends of a handle, and the handle ends include an arrangement for mounting to a casing wherein the electronic device is maintained, or to the back of the electronic device itself, and an arrangement is provided for tilting the electronic device lower end outwardly from the driver's back.

8 Claims, 9 Drawing Sheets

SUPPORT FOR AN ELECTRONIC DEVICE

BACKGROUND OF THE INVENTION

1. Field of the Invention

A support that holds an electronic device, such as a tablet or I Pad®, on the back of a motorcycle driver so as to allow a passenger seated behind the driver to conveniently operate the device without distraction to the driver.

2. Prior Art

The invention is in a unique support maintained by a harness or straps to the back of a wearer who is driving a motorcycle, where the support is arranged for vertical adjustment on the driver's back by a passenger riding behind them, and can include pouches with flaps that are conveniently available to the passenger to hold the accessories, and further gives the passenger the capability to easily tilt the support and electronic device to an optimum angle to limit screen glare, without causing a distraction to the motorcycle driver.

Where, of course, back packs that include harnesses held onto a wearer's back are common and include a number of different strap configurations. Such have generally required that the wearer remove the pack and adjust the black pack straps to move the load carrying portion. Whereas, the invention provides for the rider or passenger, seated behind the driver wearing the harness, making adjustments to the support whereon the electronic device is maintained, to include vertically adjusting its position and to tilt, as desired the lower end of the support and electronic device outwardly, and, to open and close pockets and compartments associated with the back pack without disruption to the motorcycle driver as could create a driving hazard.

Applicant is unaware of any prior arrangement for maintaining an electronic device on the back of a motorcycle driver to provide access to the device by a motorcycle passenger.

SUMMARY OF THE INVENTION

It is a principal object of the present invention to provide a support for an electronic device for operation by a motorcycle passenger during travel where that support can be mounted on a fabric material harness or belt arrangement worn by the motorcycle driver and where the motorcycle passenger can vertically adjust the supports position on the drivers back, and can tilt the support outwardly at a bottom end of the electronic device during travel, without a disruption to the concentration of the driver.

Another object of the present invention is to provide support straps that each connect, on one end to each of the shoulder straps worn by the driver, and which support straps include a movable buckle to adjust the positioning of a male connector along the support strap for connection into female couplings that are connected to opposite ends of a support handle. Which support handle opposite ends each include a mounting for holding an electronic device thereon.

Another object of the present invention is to provide bottons on each of the support handle ends that are for press fitting into holes in a case of the electronic device as the mounting.

Still another object of the present invention is to provide sections of Velcro® type connector pads for attachment to the support handle ends and rear surface of the electronic device as the mounting.

Still another object of the present invention is to provide an arrangement for tilting the lower end of the electronic device outwardly from the driver's back to conveniently tilt the device to the passengers' viewing preference during travel.

The support is for connection to a harness or belts worn by a motorcycle operator or driver that are to provide a convenient support to maintain an electronic device for use by the motorcycle passenger during travel. The support includes support straps that are for connection to harness shoulder straps, or to straps that attach to the drivers belt, and each support strap includes a buckle that mounts a male coupling for fitting into a female coupling that is connected to the ends of a handle that includes a coupling arrangement for connection to a case the contains the electronic device or to the electronic device itself. Which coupling arrangement, in one embodiment, is a button that extends outwardly from each handle end that connects to the handle strap end, and which button is to fit into a hole in the back of the casing, providing a coupling thereto. Or the handle end surface can receive a section of connection material, such as Velcro®, where an adhesive surface of one section is pressed onto each handle end, and the other section of material is press fitted onto the back of the casing. Or which connection material section can be press fitted onto the back of the electronic device for mounting the handle ends directly to the electronic device. Also, for the buttons and holes coupling, section of connection material, such as Velcro®, can also be used as a safety feature prohibiting the separation of the handle ends from the casing back surface.

The buckles mounting the male connectors are arranged to move along the length of the support straps to be movable by the passenger without affecting the drivers concentration while they are operating the motorcycle. Additionally, for the harness arrangement, pouches with flaps are provided to extend between the harness back sides where, at least one pouch, is positioned across the harness, under a lower end of the electronic device that, when appropriately filled with items, such as clothing or accessories for the electronic device, will raise the electronic device lower end and tilt it away from the drivers back, providing the passenger with an improved view of the electronic device screen and facilitating their operating a touch screen of that electronic device. Where, for the belt arrangement, the passenger can insert a folded cloth, or the like, between the electronic device lower end and driver's back to provide a tilt to the electronic device.

Additionally, the harness can include a pocket formed in the upper portion of the back thereof that is to receive a straight plastic brace fitted therein that extends a short distance upwardly from the top of the pocket, parallel to the driver's neck, to block contact of the support and electronic device mounted to that support with the driver's neck should the electronic device be pivoted upwardly around it's handle ends mounting, as when the motorcycle goes over a bump.

The harness shoulder straps that the driver fits their arms through and belt straps of the alternate arrangement, are adjustable for setting a desired vertical positioning of the support straps that include the buckle mounting the male connector that can be moved therealong by the passenger during travel as can the tilt of the electronic device by the passenger to provide the passenger with an optimal view of the electronic device and operational convenience to the passenger during travel.

DESCRIPTION OF THE DRAWINGS

In the drawings that illustrate that which is presently regarded as the best mode for carrying out the invention.

DETAILED DESCRIPTION

Figure 1:
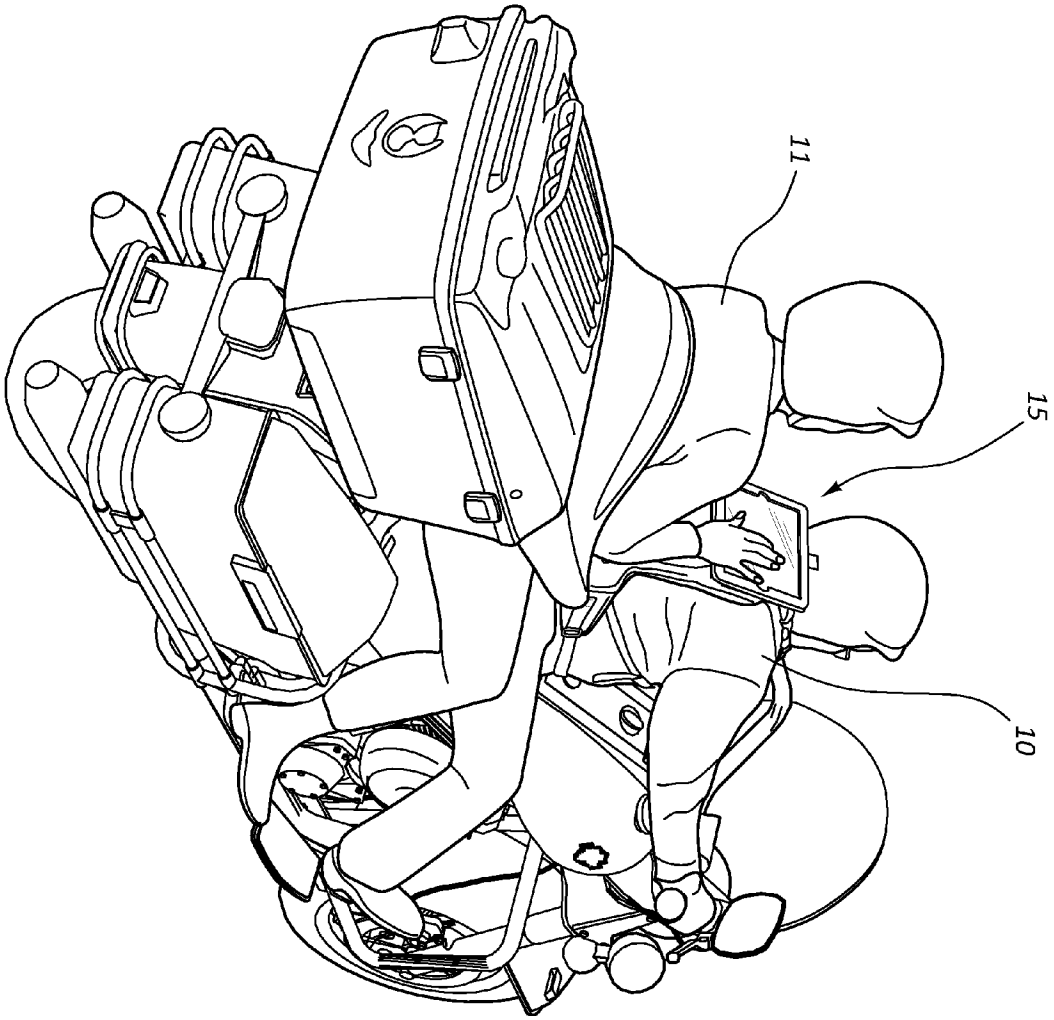
FIG. 1 is a rear prospective view of a motorcycle being operated by a driver and showing a passenger seated behind the driver and operating an electronic device maintained by a support for positioning the electronic device on the operators back.
Figure 2:
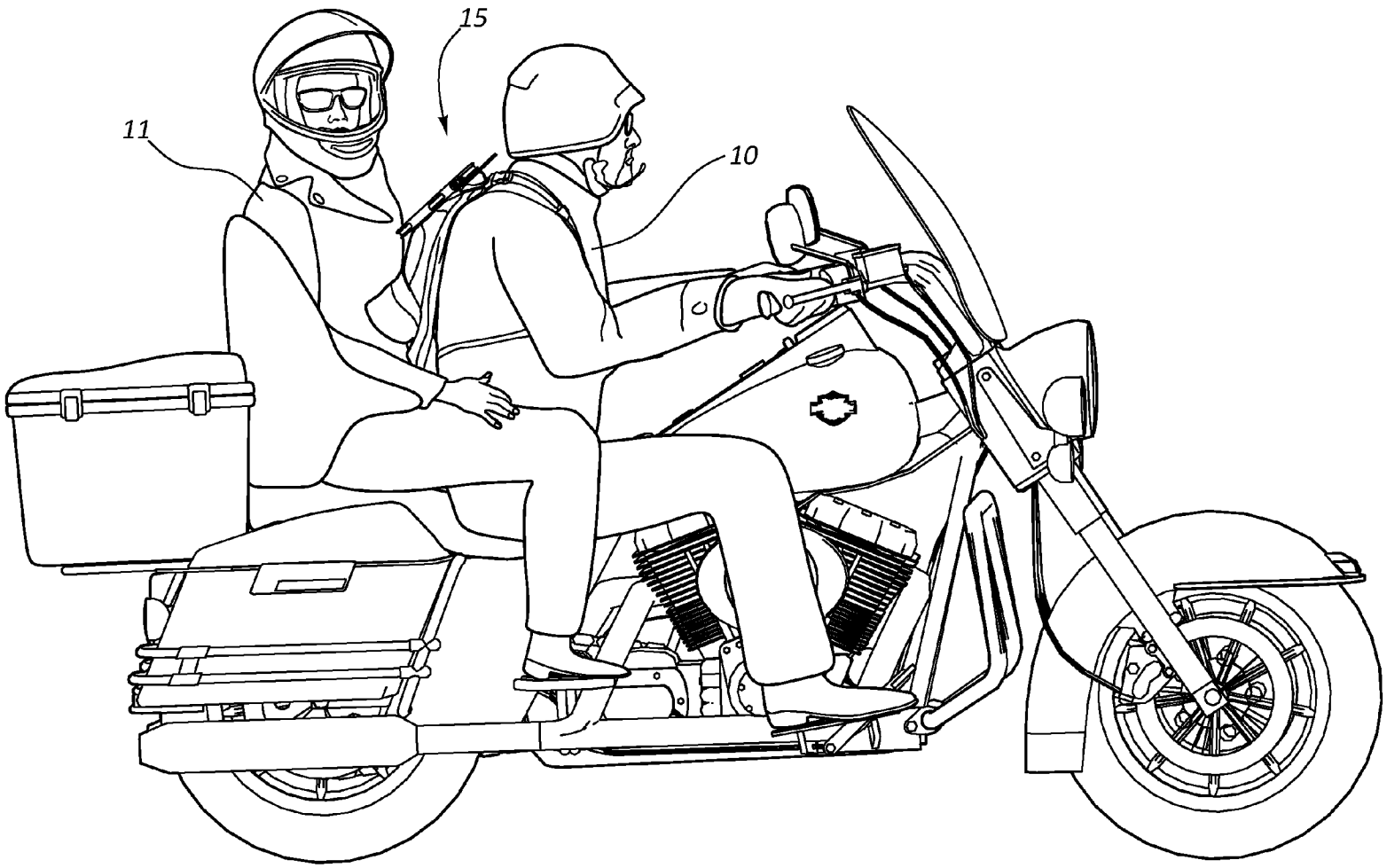
FIG. 2 is a side elevation view of the motorcycle operated by the driver with the passenger seated behind the driver as shown in FIG. 1, showing the electronic device lower end as tilted outwardly towards the passenger.
Figure 3:
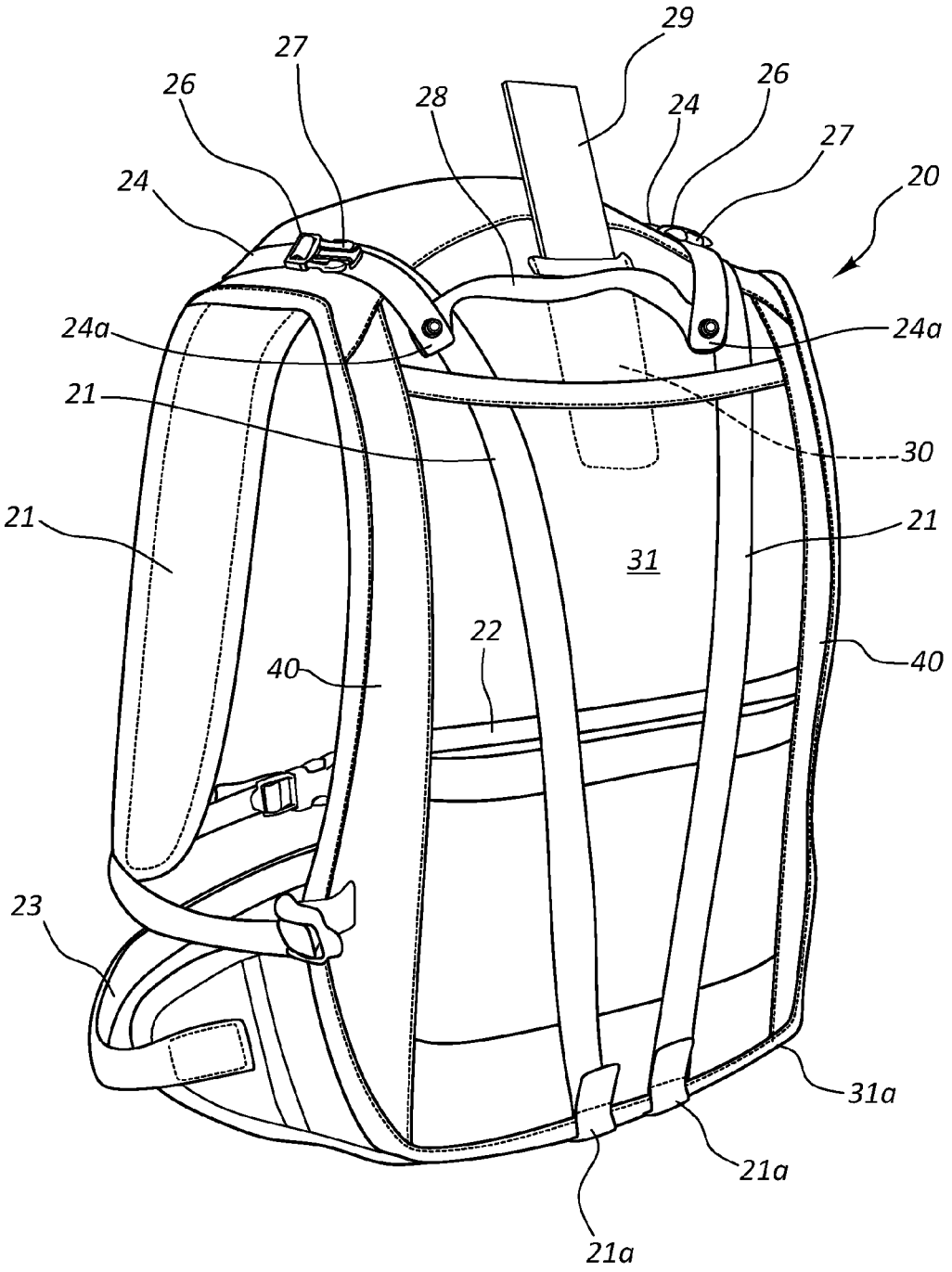
FIG. 3 is a rear profile perspective view of a harness and strap arrangement worn by the operator in FIGS. 1 and 2, showing support straps end connected to harness shoulder straps that each have a male connector connected to a buckle for travel along the support straps.

FIG. 1 shows a rear elevation perspective view of a couple driving a motorcycle with the passenger 11 shown operating a touch screen of an electronic device 15, shown as a tablet, and FIG. 2 shows a side elevation view of the motorcycle operator 10 and passenger 11. FIG. 3 shows a fabric material harness 20 that is worn by the driver 10 who fits their arms through shoulder straps 21, that pass across the drivers shoulders and connect at 21*a* to a lower end 31*a* of a harness back 31, and buckles a waist chest strap 22 around their chest and connects a waist strap 23 around their stomach, as shown also in FIG. 7. The harness 20 is a conventional fabric material harness as for strapping a pack thereto, and additionally includes support straps 24 that are for attaching a support 25, as shown in FIG. 4, whereon the electronic device 15 is maintained, as set out below.

Figure 5:
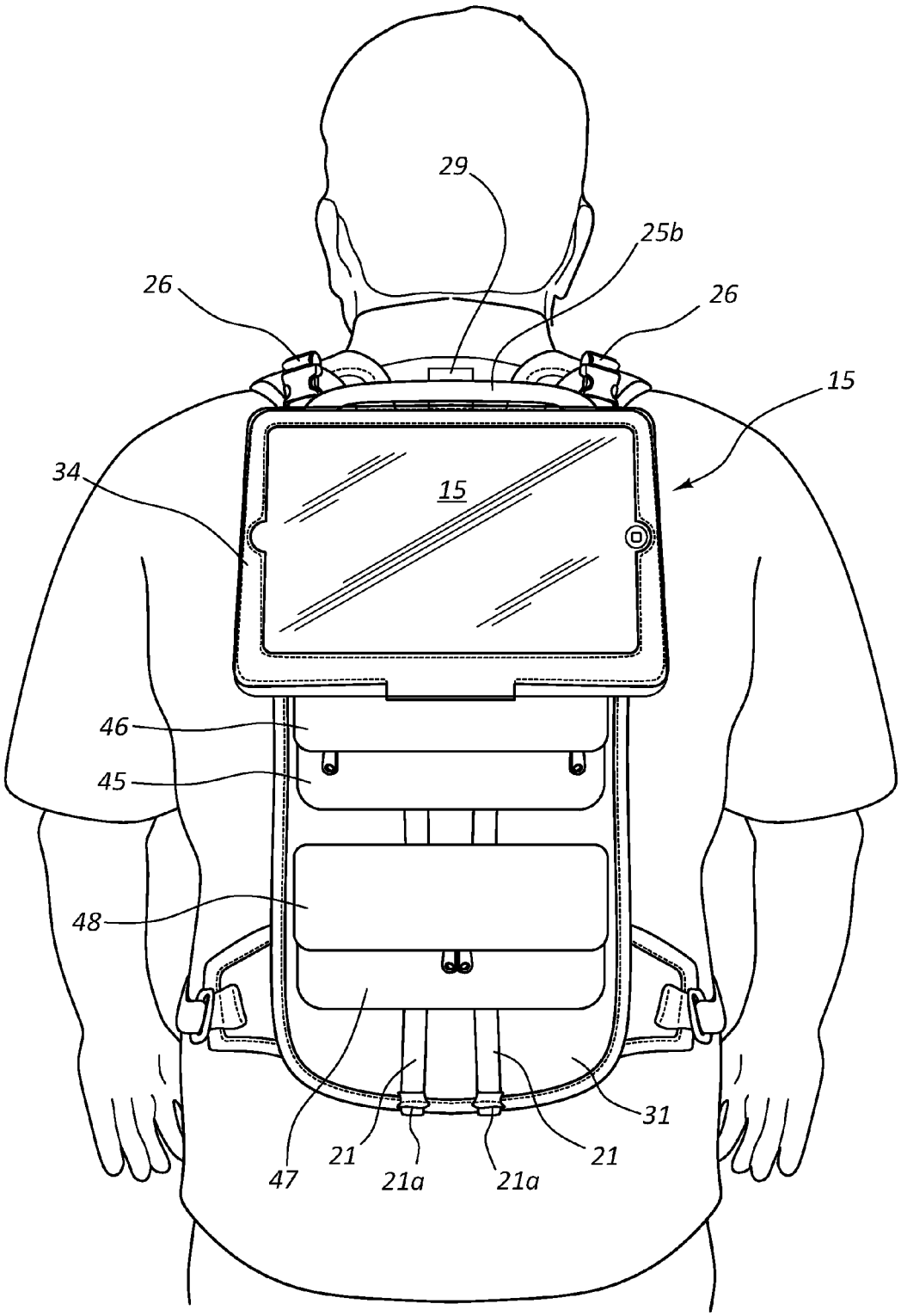
FIG. 5 is a view like that of FIG. 4 only showing the handle female connectors fitted into the support straps male ends and showing the handle strap button ends press fitted into the case holes, securing the electronic device casing onto the handle that is coupled to the support straps as the support.
Figure 6:
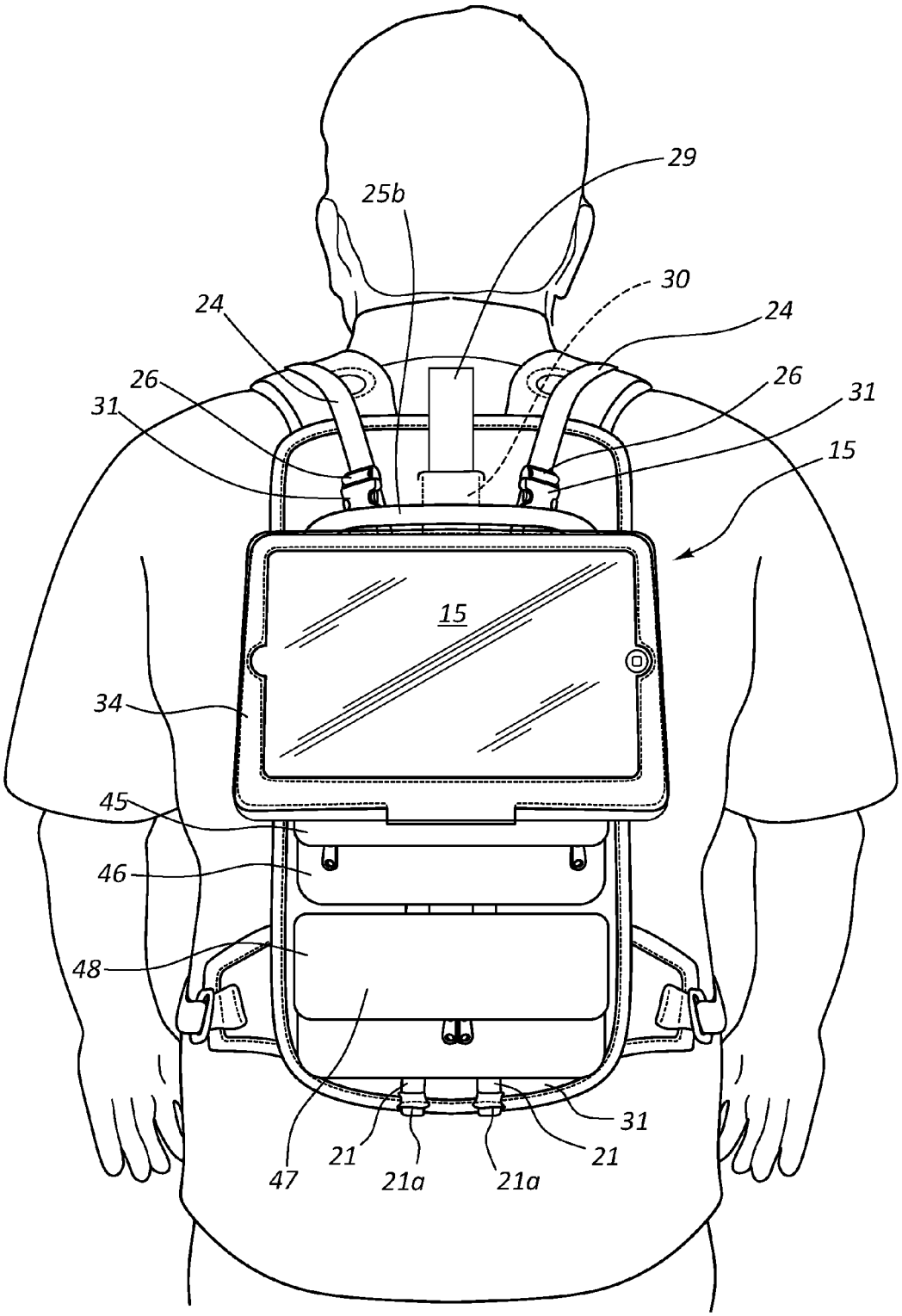
FIG. 6 is a view like that of FIG. 5 only showing the buckle and male connector as having been moved along the support straps of the support as by feeding the support straps through the buckle, lowering the case and electronic device on the driver's back.

To attach which support 25 to the support straps 24, the support straps 24 connect to the harness shoulder straps, as by sewing, and include a guide buckle 26 that a male connector 27 is fitted to arranged to travel along the support straps 24. With the buckle 26 mounting the male connector 27, as shown in FIGS. 5 and 6, is movable along support straps 24 for adjusting the vertical positioning of the male connector 27 of the support 25 to a desired location along the driver's back, as set out below. Which adjustment can be accomplished by the passenger 11 during travel.

Shown in FIG. 3, the support straps 24 ends 24*a* attach to ends of a separation strap 28 that is to maintain separation of the support straps to facilitate travel of the buckle 26 and male connector therealong, for mounting the electronic device 15, as set out below, and for maintaining a brace 29 that extends out of a pocket 30 formed in the harness back 31 that is for blocking contact of the support 25 and electronic device 15 mounted thereto during travel. Which brace 29 is preferably formed from plastic.

Figure 4:
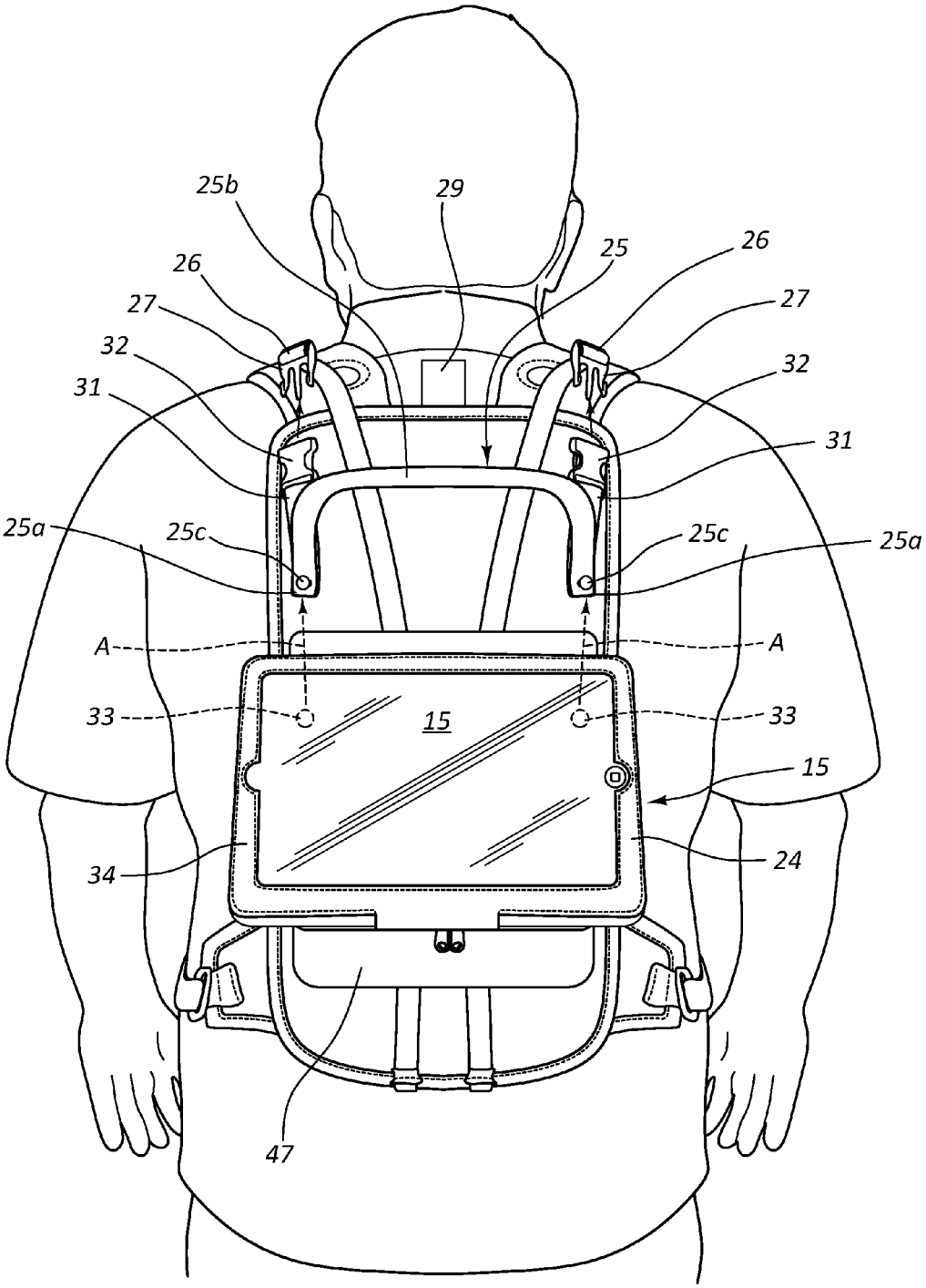
FIG. 4 is a view of the back of the harness of FIG. 3 showing female connectors connected to handle strap ends aligned for coupling into the male connectors, and showing each handle strap opposite end outer surface as having a button extending outwardly therefrom that aligns with holes, shown in broken lines, of a electronic device case for the support handle ends to press fit therein to maintain the electronic device, shown as a tablet, to which support handle ends with the support straps and handle constituting the support, and showing a brace that extends upwardly from a pocket of the harness that aligns with the driver's neck.

Shown in FIG. 4, connection straps 31 are provided for mounting the support 25 to the male connector 27 positioned along the support straps 24 so as to receive female coupling ends 32 that are for slide coupling into the male connectors 27. Which connection straps 31, on their opposite ends from the female coupling ends 32, each connect to ends 25*a* of handle 25. Which handle 25 has ends 25*a* that each include a button 25*c* that extends outwardly therefrom and connects, as shown by broken lines A in FIG. 4, into a round opening 33 formed into a case 34 that the electronic device 15 is mounted in. So arranged, the electronic device 15 case 34 round openings are pressed onto the buttons 32 to connect it onto the support 25. Which connection, as desired, can be reinforced by placement of sections of a connection material, such as Velcro®, onto the opposing surfaces of the case 34 back and handle ends 25*a* to further reinforce the coupling of the buttons 32 into the round openings 33.

With the case 34 connected to the support 25, as set out above, the assembly can be positioned and repositioned, as needed, by the passenger 11 before or during travel between the positions shown in FIGS. 5 and 6, respectively, by adjusting the positioning of each the buckle 26 and male connector 27 along the support straps 24 by appropriately sliding the buckles 26 along the support straps 24, moving the male connectors 27 therewith that the female connector 32 has been fitted into. Which case 34 and support 25 adjustment can be done without disruption to the mounting of the case 34 to the support, and, during which adjustment, the passenger can hold a center portion 25*b* of the support 25 to steady the assembly.

Figure 8:
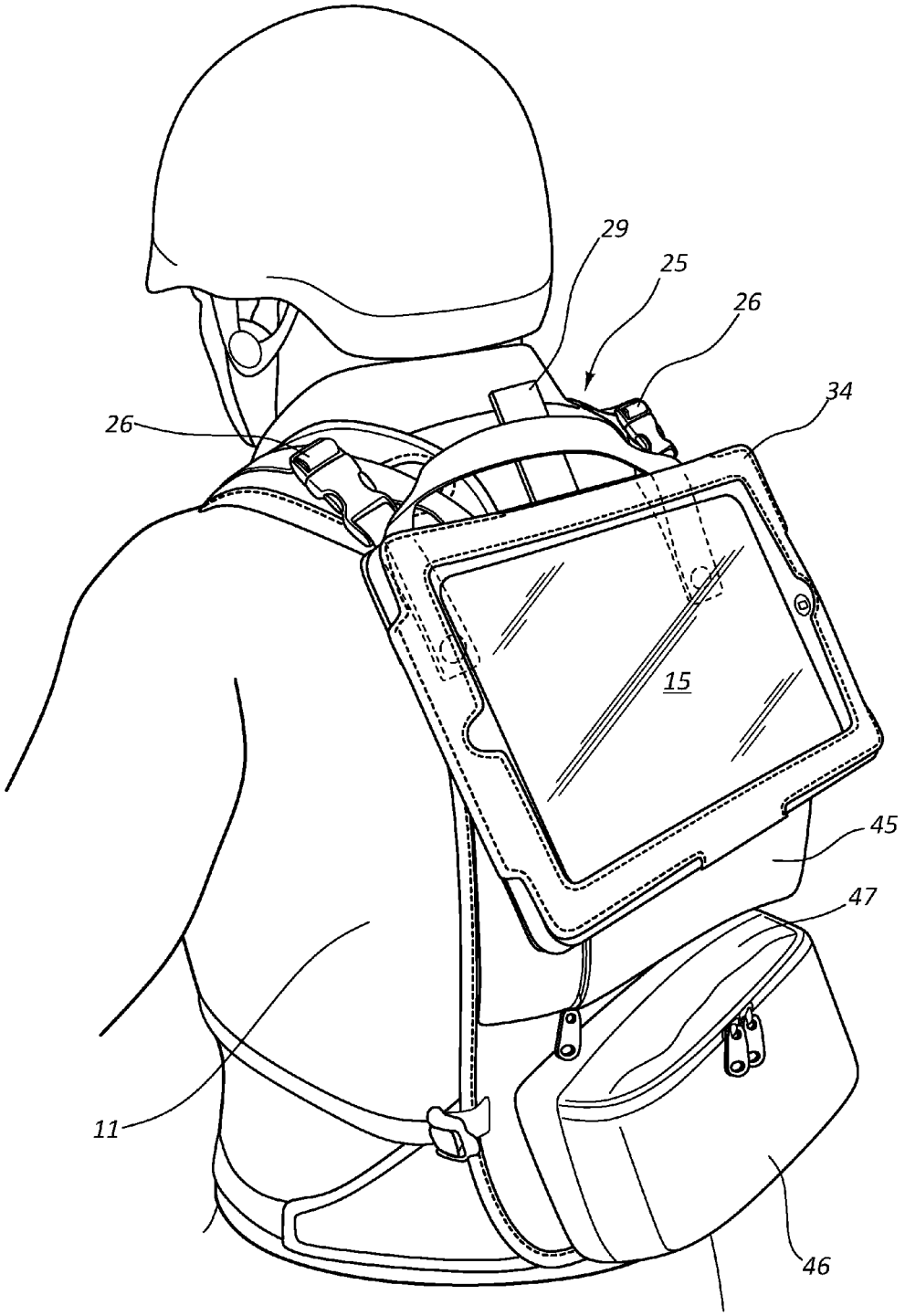
FIG. 8 shows a side elevation view of the driver of FIG. 1, showing the support mounting the case containing the electronic device, and showing pouches, with flaps, fitted across a harness back as containing items, with a center pouch shown as having items therein that extends it outwardly to support lower end of the case containing the electronic device, urging that case and electronic device lower end bottom end away from the operator.

FIG. 3 shows the fabric harness 20 as including sides 40 that connect to the harness back that includes the lower end 31*a*, which lower end connects to the ends 21 of harness straps 21. The back of the fabric harness 20, as shown in FIGS. 5 and 6, includes a lower pouch 45 with a flap 46 closure and a middle pouch 47 with a flap closure 48, that may be fitted to the harness straps 21, or to the sides 40 of the fabric harness 20, to extend across the fabric harness back. Which pouches 45 and 47 can be connected to the harness straps 21 or to sides 40, or can be arranged to be movable, within the scope of this disclosure. With the center pouch 45 preferably positioned as shown, when packed with accessory items, or the like, to a expand outwardly to a desired height above the harness back, it will function to urge the lower end of the support 25 and electronic device 15 mounted thereto a desired distance outwardly from the harness back, producing an outward tilt thereto, as shown in FIG. 8, to provide to the passenger 11, as shown in FIGS. 1 and 2, with a better viewing of the electronic device screen, or a more convenient access to the electronic device touch screen, than would be provided if the electronic device rested on the driver's back.

In practice, the driver positions the fabric harness onto his back by fitting their arms through the shoulder straps 21 and fitting the chest and waist straps 21 and 22, respectively, appropriately to their body and connecting the chest and waist strap ends. Prior to which harness positioning, the buckles 26 mounting the male connectors 27 are appropriately located along the support straps 24 in anticipation of where the passenger 11 will position the support 25 that receives the electronic device 15 fitted thereto by inserting the female connectors 32 into the male connectors 27, as shown in FIG. 4. Also the driver or passenger will fit accessory items, or the like, into the pouches 45 and 47, filling the center pouch 45 appropriately to where the support 25 and electronic device 15 will be tilted outwardly at its lower end to provide a desired tilt or slant to the electronic device 15 that is convenient to the passenger 11 for their use. During travel, should the passenger wish to raise or lower the support 25 that mounts the electronic device 15, they need only adjust the position of each of the buckles 26 mounting the male connectors 27 appropriately along the support straps 24. During which adjustment the passenger can steady the support 25 and electronic device 15 by manipulating the handle 25 center portion 25*b,* and, additionally, can change the contents of the center pouch 25 appropriately to alter the slant or tilt of the support 25 and electronic device 15. All of which alterations are accomplished without creating a distraction to the driver's 10 operation of the motorcycle. Also, to insure that the driver's 10 concentration will not be disrupted, the fabric harness includes the pocket 30 that the plastic brace 29 can be removably fitted into that will block travel of the support 25 mounting the electronic device 15 should the motorcycle hit a bump, or the like, causing the support and electronic device to rotate the lower end thereof around the support 25 connection to the support straps 24.

Alternatively, the support straps 24 can be fitted through a keeper, not shown, that the male connector 27 is mounted to with the support straps threaded through the buckle 26 that is arranged for shortening or lengthening each support straps 24. Which arrangement, it should be understood, would come within the scope of this disclosure.

Figure 9:
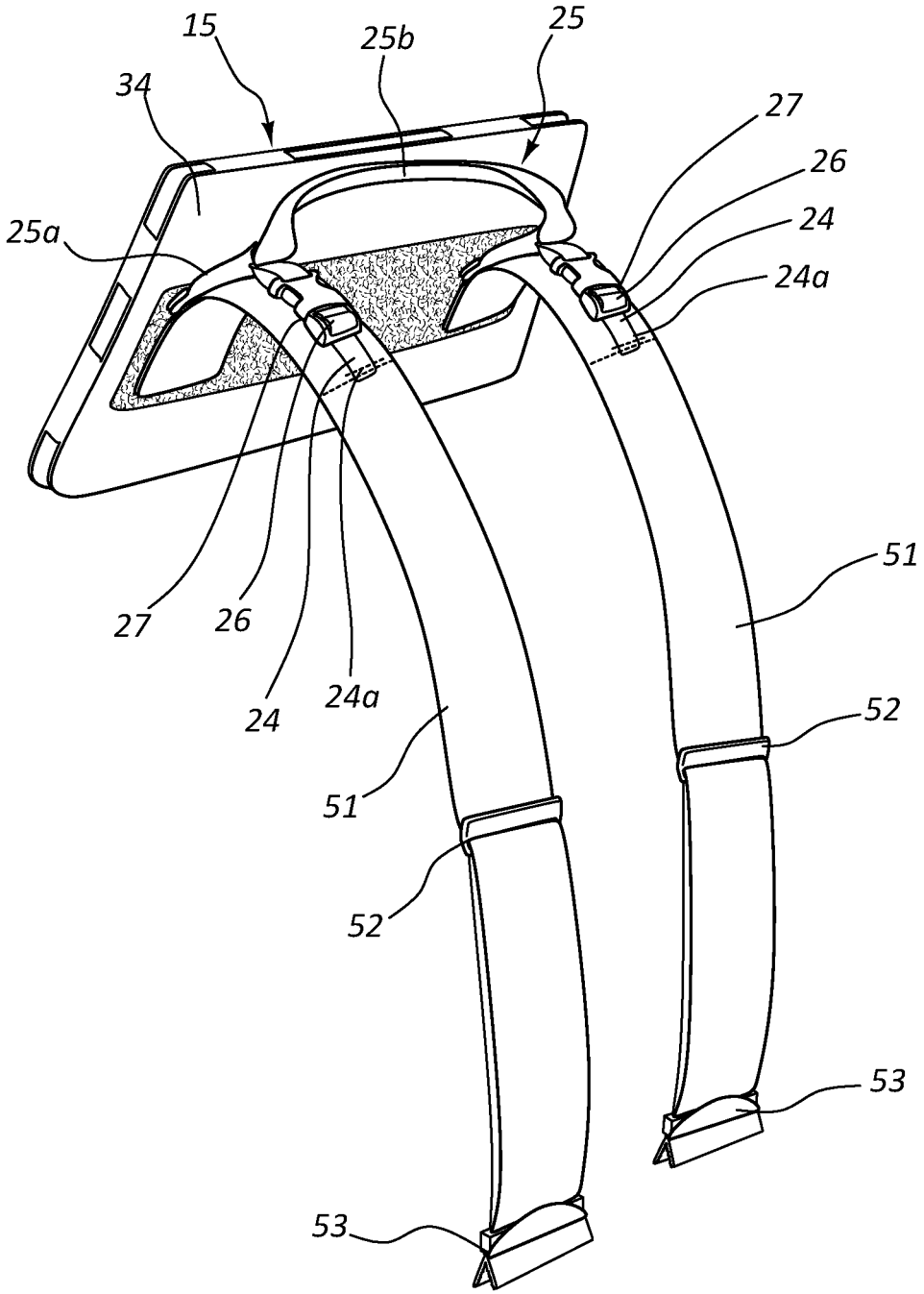
FIG. 9 shows a side elevation perspective view of an arrangement a pair of belt straps having clamp ends that are for clamping onto the driver's belt or pants waist that support straps, as shown in FIGS. 4 through 6 and 8, are connected to that each include a buckle mounting a male connector that fits into a female connector of the handle straps ends, with the opposite handle ends shown as connected to sections of a connection material for press fitting to pads of connection material on the back of a case for an electronic device.

FIG. 9 shows an alternative belt arrangement 50 to the fabric harness 20 for connection to the support 25 for maintaining the electronic device 15. Shown therein, rather than the harness 20 that the driver 10 fits and secures to his torso, the belt arrangement 50 includes to belt straps 51 that are individually adjustable in length by manually moving a slide 52 there along to length or shorten the belt straps 51 appropriately for attachment at their lower ends by manually operated clamps 53 that couple to the drivers 10 waist belt or pants waist band.

Figure 7:
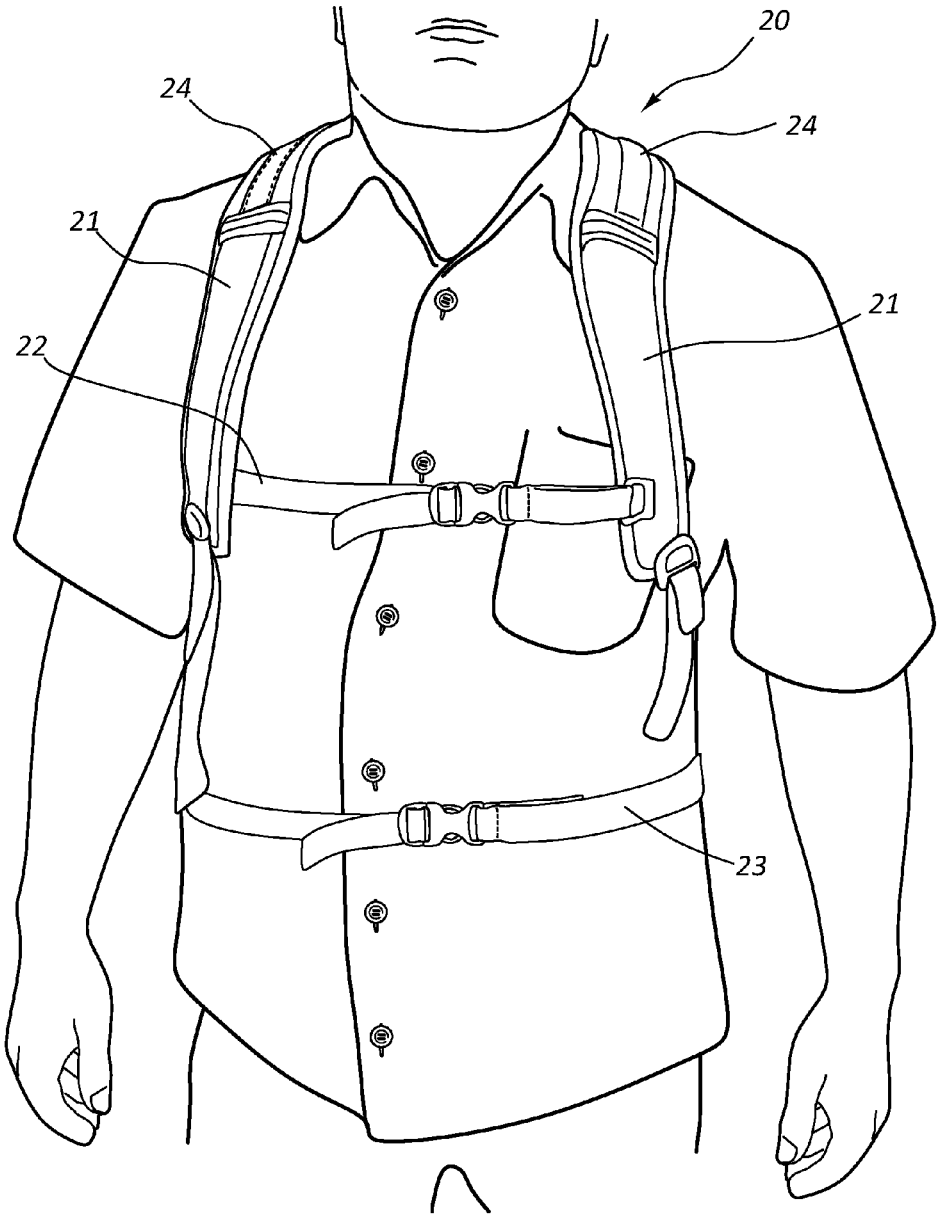
FIG. 7 shows a front elevation view of the harness and straps of FIG. 1 that the driver has fitted to their upper body.

The support 25, as set out above, is also for use with the belt arrangement 50 and includes the support straps 24 that have ends 24*a* thereof, as shown in FIG. 7, that are fitted through the buckle 26 that mounts the male connector 27, where the buckle travels along the support straps 24 for lifting or lowering the male connector 27 appropriately to receive the female connectors 32 connected therein to couple the support 25 to the support straps 24. Which female connectors 32 are mounted on the ends of connection straps 31 that connect, on their opposite ends 25*a,* to ends of handle center portion 25*b,* which handle ends 25*a,* like those of the handle 25 of FIGS. 4 through 6 and 7, can include buttons 25*c* for fitting into holes 33 formed into a rear face of the electronic device case 34. Additionally, as shown in FIG. 9, the connection straps 25 ends 25*c* can have section of a connection material, such as Velcro®, attached thereto for press fitting to opposing sections of the connection material, such as Velcro®, mounted to the case 34 or to the back of the electronic device 15, should the case 34 not be used. For titling which case 34, the passenger 11 can fit an item, such as a folded cloth, or the like, under the case 34 lower edge to produce a desired tilt to the case 34 and electronic device 15.

The alternative harness 20 and belt arrangement 50 illustrate the versatility in the use of the support 25 for maintaining an electronic device 15 for operation by a motorcycle passenger 11 during travel. During such travel, the passenger can not only conveniently operate the electronic device, they can adjust its position on the driver's 10 back without disruption of the drivers concentration on driving the motorcycle. Where a tablet with tablet case is shown as the electronic device 15, it should be understood that any appropriate electronic device, such as a cell phone, could be used with the support 25 of the invention and comes within the scope of this disclosure.

Herein above has been shown and described a preferred embodiment of the support 25 for supporting an electronic device along with alternative arrangements of a shoulder harness and belt straps for maintaining the support of my invention. It should, however, be understood that the present disclosure is made by way of example only and that variations are possible without departing from the subject matter coming within the scope of the following claims and a reasonable equivalency thereof, which subject matter I regard as my invention.

I claim:

1. A support for maintaining an electronic device positioned on the back of a driver of a motorcycle for use by a motorcycle passenger comprising, support straps connected on first ends to shoulder straps that extend rearwardly from the driver's front, across the drivers shoulder blades, where said support straps each includes a buckle that it is threaded through, and said buckle includes a first coupling that is movable along said support strap to elevate or lower said first connector; and connection straps are provided that each include, on a first end, a second coupling for fitting into, to releasably connect to said first coupling, and said connection straps opposite second ends are connected to a cross strap having ends that include coupling means for releasable connecting to a rear surface of an electronic device.

2. The support for maintaining an electronic device as recited in claim 1, wherein the first coupling is male member that is mounted to the buckle.

3. The support for maintaining an electronic device as recited in claim 1, wherein the first coupling male member is for coupling and releasably locking into a female member secured to the end of the connection strap opposite second ends.

4. A support for maintaining an electronic device as recited in claim 1, wherein the cross strap is a handle and includes buttons that extend outwardly from each said handle end that are to fit into, to couple into, aligned spaced holes formed in a back surface of a case as the coupling means for maintaining the electronic device.

5. A support for maintaining an electronic device as recited in claim 1, further including sections of connecting material having backings that will adhesively bond, respectively, to the cross strap ends surfaces and to the back surface of the electronic device, which connecting material sections will releasably connect when pressed together.

6. A support for maintaining an electronic device as recited in claim 5, wherein the sections of connecting material are Velcro® pads.

7. A support for maintaining an electronic device as recited in claim 1, wherein the shoulder straps are components of a fabric harness worn by the driver and a pouch is connected at its ends to said harness to extend across a back of said harness that includes a flap, and which said pouch is positioned under a lower end of the electronic device such that, when items are installed therein, said pouch surface will extend outwardly to lift said lower end of said electronic device to provide a tilt of said lower end towards a passenger seated behind said driver.

8. A support for maintaining an electronic device as recited in claim 7, wherein the fabric harness that is worn by the driver and includes a center pocket in a top portion of its rear surface that is adjacent to the driver's neck area and is to receive a brace, formed from a section of plastic material, fitted therein that is to block the electronic device from contacting said driver's neck during travel.

* * * * *